US006172347B1

(12) United States Patent
Lee

(10) Patent No.: US 6,172,347 B1
(45) Date of Patent: Jan. 9, 2001

(54) MICROWAVE OVEN WITH HALOGEN LAMPS

(75) Inventor: Kwan-Ho Lee, Changwon Gyeongnam (KR)

(73) Assignee: LG Electronics Inc., Seoul (KR)

( * ) Notice: Under 35 U.S.C. 154(b), the term of this patent shall be extended for 0 days.

(21) Appl. No.: 09/362,895

(22) Filed: Jul. 29, 1999

(30) Foreign Application Priority Data

Jul. 29, 1998 (KR) ..... 98-30648

(51) Int. Cl.[7] ..... H05B 6/28

(52) U.S. Cl. ..... 219/685; 219/754; 219/756; 392/416; 392/418

(58) Field of Search ..... 219/685, 680, 219/754, 756, 757; 392/416, 418

(56) References Cited

U.S. PATENT DOCUMENTS 4,728,763 * 3/1988 Bell et al. ..... 219/685
5,313,036 * 5/1994 Chartrain et al. ..... 219/685

FOREIGN PATENT DOCUMENTS 3-67931 * 3/1991 (JP) ..... 219/685
3-110324 * 5/1991 (JP) ..... 219/685
5-52352 * 3/1993 (JP) ..... 219/757

* cited by examiner

*Primary Examiner*—Philip H. Leung
(74) *Attorney, Agent, or Firm*—Fleshner & Kim, LLP

(57) ABSTRACT

A microwave oven with halogen lamps is disclosed. In the microwave oven, two upper halogen lamps are installed on the top wall of a cavity of the microwave oven at a position corresponding to the central portion of a turntable. Two lower halogen lamps are installed on the bottom wall of the cavity so as to be diagonally opposite to the upper lamps and to not overlap with the upper lamps. Therefore, the light, emanating from the upper and lower lamps, is uniformly transmitted to the total area on the turntable. The upper lamps are positioned to overlap with the central portion of the turntable. The lower lamps individually have an output power of lower than that of each upper lamp. The lower lamps are positioned to be radially spaced apart from the central portion of the turntable. The microwave oven of this invention thus uniformly heats and cooks food laid on the turntable while effectively preventing thermal damage of a turntable motor due to heat of the lower lamps.

17 Claims, 3 Drawing Sheets

MICROWAVE OVEN WITH HALOGEN LAMPS

BACKGROUND OF THE INVENTION

1. Field of the Invention

The present invention relates, in general, to a microwave oven with halogen lamps and, more particularly, to a microwave oven designed to uniformly heat food in a cavity and to reduce the negative effect of the heat, emanating from the halogen lamps, on the interior equipment of the microwave oven.

2. Description of the Prior Art

As well known to those skilled in the art, a variety of cooking devices have been proposed and used. Of the cooking devices, the primary one is cooking ware, which is designed to have a shape suitable for containing food therein and is laid on a heater so as to be directly heated by the heater while cooking.

In addition, several types of electric cooking devices, designed to directly or indirectly utilize electric power while cooking, have been proposed and used. An example of conventional electric cooking devices is a microwave oven using a magnetron as a heat source. In such a microwave oven, the magnetron is electrically operated to generate microwaves and applies the microwaves to food in a cavity, thus allowing the microwaves to cause an active molecular motion in the food. Such an active molecular motion in the food generates molecular kinetic energy, thus heating and cooking the food. Such microwave ovens are advantageous in that they have a simple construction and are convenient to a user while cooking, and easily and simply heat food in the cavity. The microwave ovens are thus somewhat preferably used for some cooking applications, such as a thawing operation for frozen food or a heating operation for milk requiring to be heated to a desired temperature.

However, such microwave ovens also have the following problems. That is, the ovens have a defect in their heating style in addition to limited output power of the magnetron, and so it is almost impossible to freely or preferably use them for a variety of cooking applications, without limitation. In a detailed description, the conventional microwave ovens only utilize a magnetron as a heat source, thus undesirably having a single heating style. In addition, the output power of the magnetron, installed in such ovens, is limited to a predetermined level. Therefore, the conventional microwave ovens fail to provide a quick and highly effective cooking operation. During a cooking operation utilizing such a microwave oven, food in a cavity is heated at its internal and external portions at the same time, and this may be an advantage of the oven in some cases. However, such a heating style may result in a disadvantage while cooking some food. For example, the cooking style of the conventional microwave ovens is not suitable for cooking pizza for reasons that will be described in more detail later herein. Another disadvantage, experienced in the conventional microwave ovens, resides in that the ovens exceedingly remove moisture from food.

In an effort to overcome the above-mentioned problems, several types of microwave ovens, having another heat source in addition to a magnetron, have been proposed and used. For example, a microwave oven, having a convection heater in addition to a magnetron in a casing and originally designed to be used for a variety of cooking applications, has been proposed. However, such a convection heater only acts as a single heat source, thus failing to allow the microwave oven to have a variety of operational functions.

In a brief description, the conventional microwave ovens are problematic in that they have a single heating style utilizing microwaves, limited output power of a magnetron, and cause the evaporation of an exceeding amount of moisture from food. The microwave ovens, having another heater in addition to a magnetron, fail to completely overcome the problems experienced in the conventional microwave ovens.

In order to solve the problems of the conventional microwave ovens, another type of microwave oven, utilizing a light wave, has been proposed. In this microwave oven, a lamp, wherein at least 90% of the radiation energy has a wavelength of not longer than 1 $\mu$m, is used as the additional heat source. In said microwave oven, both visible rays and infrared rays from the lamp are appropriately used, and it is possible to preferably heat the exterior and interior of food while making the most of characteristics of the food. An example of such a lamp is a halogen lamp.

Due to a difference in wavelengths between the infrared rays and visible rays emanating from a halogen lamp, the heating styles for the exterior and interior of food are different from each other. While cooking pizza utilizing a halogen lamp, it is possible to appropriately heat the pizza in a way such that the exterior of the pizza is heated to become crisp and the interior is heated to be soft while maintaining appropriate moisture.

FIG. 1 is a conventional microwave oven utilizing a halogen lamp as an additional heat source. As shown in the drawing, the microwave oven comprises two halogen lamps 12 installed on the top wall 10 of a cavity 2. The microwave oven uses the light waves, radiated from the lamps 12, for heating food in the same manner as that described above, with the characteristics of the light waves remaining the same as that described above.

A light reflection plate 16 is installed at a position above the halogen lamps 12, thus reflecting any light waves, emanating upwardly from the lamps 12, back downwardly into the cavity 2. A plurality of light transmitting holes 18 are formed on the top wall 10 of the cavity 2, with the halogen lamps 12 being held on the top wall.

In the conventional microwave oven of FIG. 1, two lower halogen lamps (not shown), having the same construction as that of the two upper lamps 12, are provided on the bottom wall 11 of the cavity 2.

That is, upper and lower halogen lamps are respectively provided on the top and bottom walls 10 and 11 of a cavity 2 at corresponding positions in a conventional microwave oven. However, the microwave oven, having such a typical lamp structure, is problematic as follows.

In the typical halogen lamp structure, two halogen lamps are positioned on each of the top and bottom walls 10 and 11 of the cavity 2 at the center. The two lower halogen lamps, positioned on the bottom wall 11 of the cavity 2, may overheat a turntable motor (not shown) within the cavity 2. That is, the cavity 2 is provided with both a turntable used for supporting food thereon and a turntable motor used for rotating the turntable. The two lower halogen lamps, provided on the center of the bottom wall 11, are positioned around the turntable motor. Therefore, heat, emanating from the lower halogen lamps, is directly transmitted to the turntable motor, thus undesirably overheating the motor. Since a conventional halogen lamp generates heat having a high temperature of not lower than 1000° C., the turntable motor may be thermally and seriously damaged during a cooking operation of the microwave oven.

In addition, the upper and lower halogen lamps are provided on the top and bottom walls of the cavity at corresponding positions, and so the lamps may fail to uniformly heat food within the cavity. That is, the food is laid on and rotated by the turntable, while the position of the upper and lower lamps is fixed. The lamps thus concentrate heat to a portion of the food, and so the food fails to be uniformly heated or cooked.

SUMMARY OF THE INVENTION

Accordingly, the present invention has been made keeping in mind the above problems occurring in the prior art, and an object of the present invention is to provide a microwave oven, which has a halogen lamp designed to uniformly heat food in a cavity.

Another object of the present invention is to provide a microwave oven, which is designed to almost completely prevent its interior equipment, particularly, a turntable motor, from being thermally damaged by heat emanating from a halogen lamp.

In order to accomplish the above object, the present invention provides a microwave oven, comprising: an upper light radiating means installed on a top wall of a cavity of the microwave oven at a position corresponding to a central portion of a turntable; and a lower light radiating means installed on a bottom wall of the cavity so as to be diagonally opposite to the upper light radiating means and to not overlap with the upper light radiating means, whereby light, emanating from the upper and lower light radiating means, is uniformly transmitted to a total area on the turntable.

In the microwave oven, the upper light radiating means is positioned to overlap with the central portion of the turntable.

The lower light radiating means has an output power of lower than that of the upper light radiating means.

The lower light radiating means is positioned to be radially spaced apart from the central portion of the turntable.

The microwave oven of this invention thus uniformly heats and cooks food laid on the turntable within the cavity and effectively prevents the turntable motor from being overheated by the lower light radiating means.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
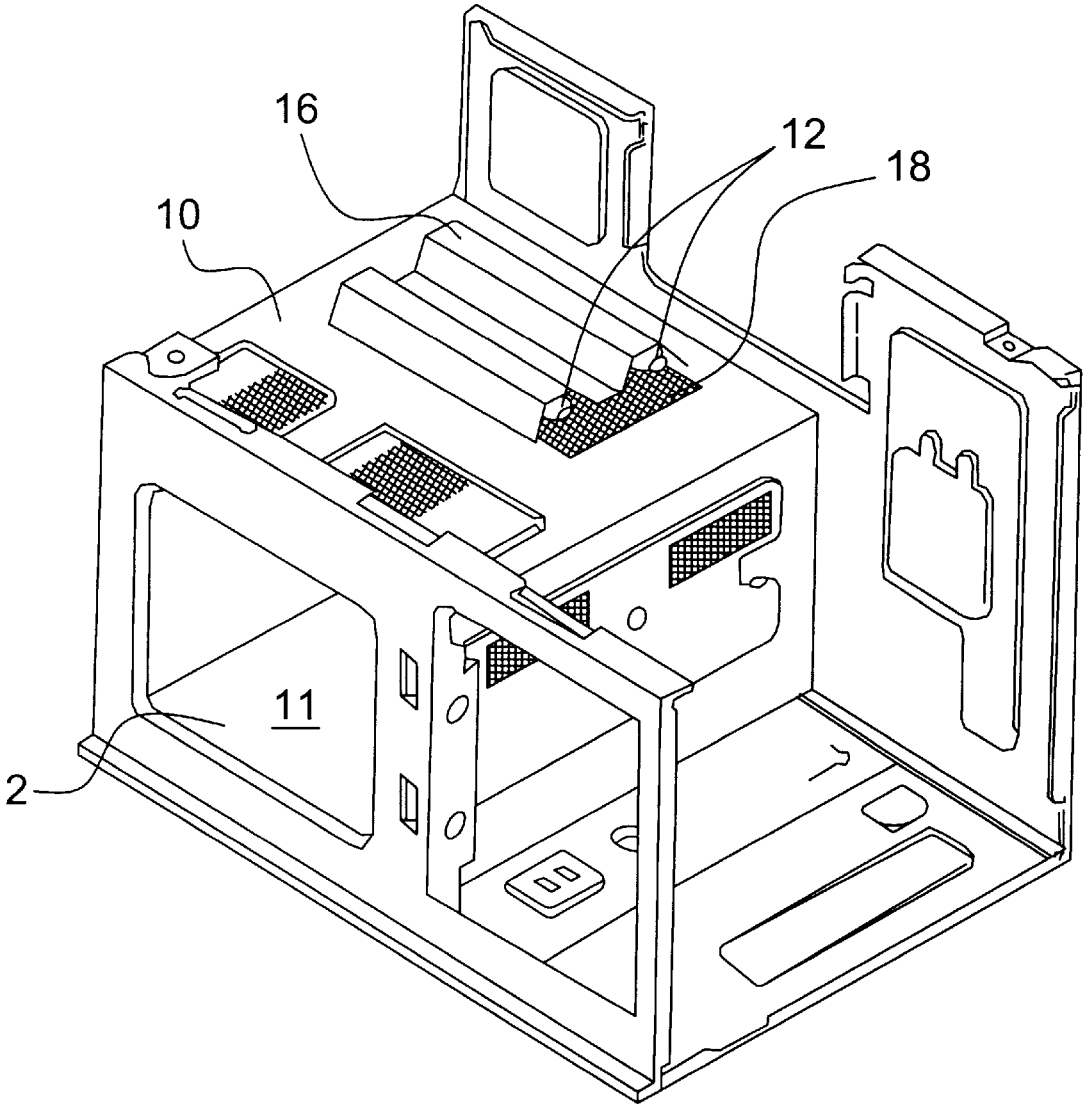
BACKGROUND ART FIG. 1
FIG. 1 is a perspective view, showing the construction of a conventional microwave oven utilizing halogen lamps as a heat source.
Figure 2:
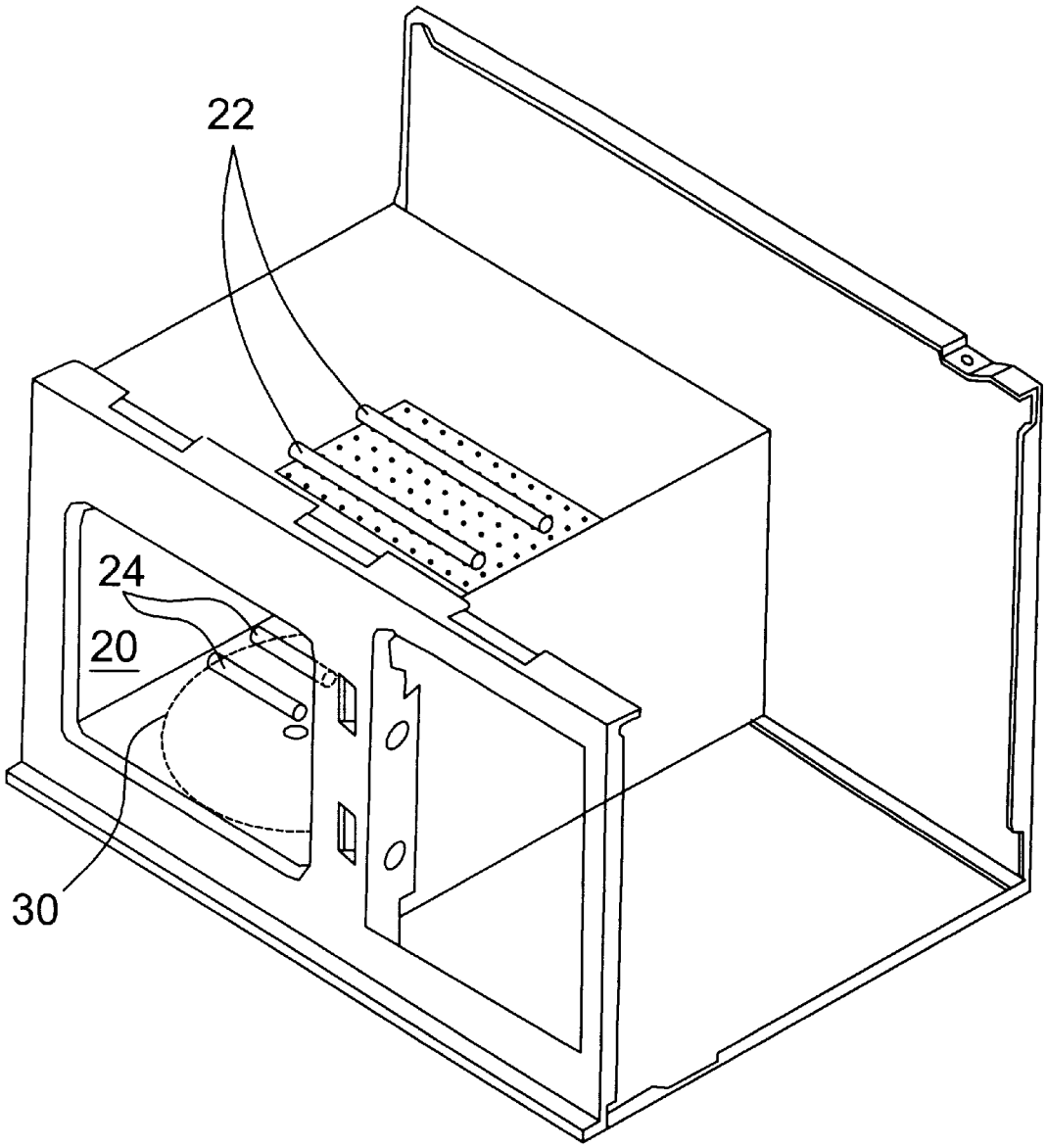
FIG. 2 is a perspective view, showing the position of upper and lower halogen lamps respectively provided on the top and bottom walls of a cavity in a microwave oven in accordance with the preferred embodiment of the present invention.
Figure 3:
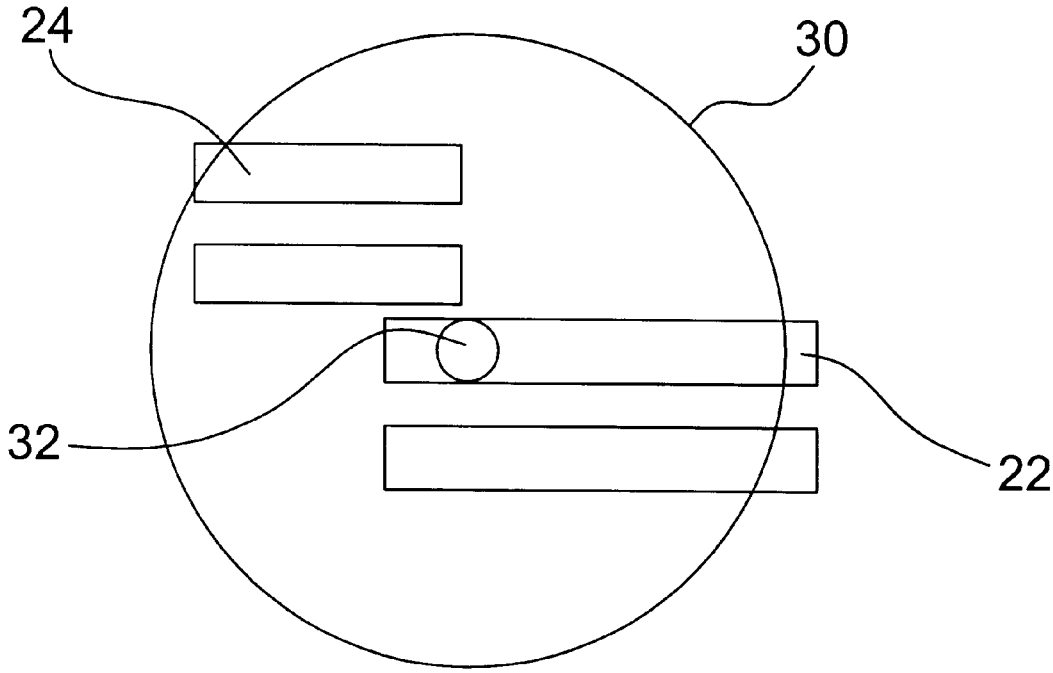
FIG. 3 is a plan view, showing the position of the upper and lower halogen lamps of this invention.

FIGS. 2 and 3 show the position of upper and lower halogen lamps provided on the top and bottom walls of a cavity in a microwave oven of this invention. As shown in the drawings, the microwave oven of this invention is designed to position the upper and lower halogen lamps 22 and 24 in a way such that the lamps 22 and 24 do not overlap each other and do not emanate heat waves directly toward each other.

When seen from the top of the microwave oven as shown in FIG. 3, the two upper lamps 22 are placed at a position corresponding to the second quarter of the circular turntable 30, while the two lower lamps 24 are placed at a position corresponding to the fourth quarter of the turntable 30. That is, the upper and lower lamps 22 and 24 are positioned to be diagonally opposite to each other and more uniformly heat and cook food laid on the turntable 30.

Of course, the lamps 22 and 24 are positioned within the boundary of the turntable 30, and so it is possible to reduce the area for installing the lamps 22 and 24 on the top and bottom walls of the cavity 20 in comparison with a conventional lamp structure. Therefore, it is easy to design the cooling device for the halogen lamps.

In the microwave oven of this invention, a turntable motor (not shown) is installed at a position around the lower lamps 24. That is, the turntable motor is positioned under the rotating shaft 32. Therefore, it is preferable to design the position of the lower lamps 24 in a way such that the lamps 24 are spaced apart from the center of the bottom wall of the cavity at which the motor is positioned.

Therefore, in the preferred embodiment of the drawings, the lower lamps 24 are positioned outside the rotating shaft 32 of the turntable motor, while the upper lamps 22 are positioned above the shaft 32. When the lower lamps 24 are positioned outside the rotating shaft 32 of the turntable motor, it is possible to protect the turntable motor from heat emanating from the lower lamps 24. Since the upper lamps 22 are placed above the shaft 32, the upper and lower lamps 22 and 24 uniformly heat and cook food laid on the turntable 30.

In the present invention, it is preferable to reduce the output power of the lower halogen lamps 24 because heat, emanating from the lamps 24, is easily transmitted to the turntable motor. Of course, it is necessary to maintain a desired total output power of the upper and lower lamps, which is required to appropriately heat and cook food on the turntable 30. In order to accomplish the above object, the output power of the upper and lower lamps 22 and 24 is designed so that the power of the upper lamps 22 is higher than that of the lower lamps 24.

In the microwave oven of this invention, a halogen lamp having a higher output power is used as each upper lamp 22, while a halogen lamp having a lower output power is used as each lower lamp 24. For example, two halogen lamps, individually having an output power of 1,500 W, may be preferably used as the upper lamps 22. On the other hand, two halogen lamps, individually having an output power of 750 W, may be preferably used as the lower lamps 24.

When the upper and lower halogen lamps 22 and 24 are designed as described above, it is possible to accomplish a desired total output power of the upper and lower lamps 22 and 24 while effectively preventing thermal damage of the turntable motor.

In the above description, the structure of the present invention is used in a microwave oven with halogen lamps. However, it should be understood that the structure of this invention may be preferably used in a microwave oven having an infrared heater.

As described above, the present invention provides a microwave oven with halogen lamps.

In the microwave oven of this invention, the upper and lower halogen lamps are positioned in a way such that they do not overlap each other. It is thus possible to uniformly heat and cook food laid on the turntable.

The lower halogen lamps are spaced apart from the rotating shaft of a turntable motor, and so it is possible to prevent the motor from being thermally damaged by heat emanating from the lower lamps. In addition, the lower halogen lamps individually have an output power which is lower than that of each of the upper lamps. Therefore, the operational effect of preventing thermal damage of the turntable motor is more improved.

Another advantage of the present invention resides in that it is possible to reduce the area for installing the upper and lower lamps on the top and bottom walls of the cavity in comparison with a conventional lamp structure. Therefore, it is easy to design the cooling device for the halogen lamps.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

What is claimed is:

1. A microwave oven, comprising:

an upper light radiating device installed on a top wall of a cavity of the microwave at a position covering a central portion of a turntable and one side of the turntable; and a lower light radiating device installed on a bottom wall of said cavity at a position located at a side of the central portion of the turntable opposite to the upper light radiating device such that the lower light radiating device does not overlap with the upper light radiating device, and wherein both the upper light radiating device and the lower light radiating device extend only partially across the cavity.

2. The microwave oven according to claim 1, wherein said upper light radiating device is positioned to overlap with the central portion of the turntable.

3. The microwave oven according to claim 1, wherein said lower light radiating device has an output power that is lower than that of said upper light radiating device.

4. The microwave oven according to claim 1, wherein said lower light radiating device is positioned to be radially spaced apart from the central portion of the turntable.

5. The microwave oven according to claim 1, wherein the lower light radiating device is configured such that it covers only approximately one quarter of the turntable.

6. The microwave oven according to claim 5, wherein the upper light radiating device covers a quarter of the turntable that is diagonally opposite the quarter of the turntable covered by the lower light radiating device.

7. The microwave oven according to claim 6, wherein the upper light radiating device has a length that is approximately two thirds the width of the cavity.

8. The microwave oven according to claim 1, wherein the lower light radiating device has a length that is approximately half the width of the cavity.

9. The microwave oven according to claim 8, wherein the lower light radiating device is positioned to cover one quarter of the turntable, and wherein the upper light radiating device is configured to cover a quarter of the turntable diagonally opposite the quarter covered by the lower light radiating device.

10. A microwave oven, comprising:

first light means for radiating light into a cavity of the microwave oven, wherein the first light means is positioned above the cavity and over a first quarter of a turntable of the microwave oven; and second light means for radiating light into the cavity of the microwave oven, wherein the second light means is positioned below the cavity and under a second quarter of the turntable that is diagonally opposite the first quarter and wherein the first light means and the second light means are configured such that they extend substantially less than a full width of the cavity.

11. The microwave oven of claim 10, wherein the first light means is positioned over a central portion of the turntable.

12. The microwave oven of claim 10, wherein an output power of the first light means is greater than an output power of the second light means.

13. A microwave oven, comprising:

a first heating device configured to radiate heating energy into a cavity of the microwave oven, wherein the first heating device is positioned above the cavity and over a first quarter of a turntable of the microwave oven; and a second heating device configured to radiate heating energy into the cavity of the microwave oven, wherein the second heating device is positioned below the cavity and under a second quarter of the turntable that is diagonally opposite the first quarter and wherein the first heating device and the second heating device are configured such that they extend substantially less than a full width of the cavity.

14. The microwave oven of claim 13, wherein the first heating device is positioned over a central portion of the turntable.

15. The microwave oven of claim 13, wherein an output power of the first heating device is greater than an output power of the second heating device.

16. The microwave oven of claim 13, wherein the first heating device and the second heating device comprise lamps that output light.

17. The microwave oven of claim 13, wherein the first heating device and the second heating device comprise infrared heaters.

* * * * *